US006942094B2

(12) United States Patent
Coulson

(10) Patent No.: US 6,942,094 B2
(45) Date of Patent: Sep. 13, 2005

(54) SPORTBOARD STORAGE APPARATUS

(75) Inventor: Wilmot Maxwell Coulson, Calgary (CA)

(73) Assignee: WMC Holding Incorporated, Calgary (CA)

( * ) Notice: Subject to any disclaimer, the term of this patent is extended or adjusted under 35 U.S.C. 154(b) by 137 days.

(21) Appl. No.: 10/314,207

(22) Filed: Dec. 9, 2002

(65) Prior Publication Data

US 2004/0108233 A1 Jun. 10, 2004

(51) Int. Cl.[7] ..... B65D 85/20; A47F 7/00; A47G 1/10; E05B 73/00

(52) U.S. Cl. ..... 206/315.1; 70/19; 211/70.5; 211/85.7; 248/316.4

(58) Field of Search ..... 206/315.1; 150/154, 150/161, 163; 224/609, 917; 211/70.5, 85.7, 89.01; 70/14, 18–19, 58; 248/316.1, 316.4, 316.6, 316.8

(56) References Cited

U.S. PATENT DOCUMENTS 4,319,686 A * 3/1982 Avocat ..... 211/70.5
4,536,926 A * 8/1985 Pantaleo ..... 24/523
4,878,585 A 11/1989 Orestano
5,014,955 A 5/1991 Thompson
5,035,389 A 7/1991 Wang
5,120,012 A 6/1992 Rosenau
5,226,625 A 7/1993 Hanna
5,282,637 A 2/1994 McCreadie
5,301,818 A 4/1994 Dix
5,305,897 A 4/1994 Smith
5,344,056 A * 9/1994 Challoner et al. ..... 224/581
5,492,254 A * 2/1996 Challoner et al. ..... 224/586
5,601,196 A 2/1997 Heer et al.
5,706,680 A * 1/1998 Wroble ..... 70/18
5,799,915 A 9/1998 Morey
5,833,078 A 11/1998 York
5,884,781 A 3/1999 Ehrhart
5,967,314 A * 10/1999 McGovern ..... 206/315.1

* cited by examiner

*Primary Examiner*—Bryon P. Gehman
(74) *Attorney, Agent, or Firm*—Bennett Jones LLP

(57) ABSTRACT

A sportboard storage apparatus, which is mountable onto a supporting surface, and which can be modified to store a variety of different types of boards which have two opposed ends that are catchable. Such as surfboards, skateboards and skis. The apparatus comprises two parts, one part of which is mounted to the support surface, and the other part of which is slideably attached to the mounted part. The sportboard is held in the apparatus by a pair of sleeves, which engage the ends of the sportboard and hold it in place on the apparatus. The apparatus provides an easy way to store sportboards.

22 Claims, 6 Drawing Sheets

A.

B.

SPORTBOARD STORAGE APPARATUS

FIELD OF THE INVENTION

This invention relates to an apparatus for storage of sportboards which have two opposed ends that are catchable, and in particular an apparatus which is mountable onto a supporting surface.

BACKGROUND OF THE INVENTION

The proper storage of sportboards such as skateboards, snowboards and surfboards, is necessitated by the fact that if these items are not properly stored they may injure persons, or alternatively the sportboard itself, or surrounding area, may become damaged. Because of their generally unusual shapes, sizes or characteristics (such as wheels or keels), sportboards can generally not be satisfactorily stored on shelves. If leaned against a wall, sportboards tend to fall over because of their rounded ends, and they therefore pose a hazard to anyone nearby who might be hit by the falling board, or to someone who later trips over the board.

For these reasons, a storage apparatus for sportboards is required which provides a means to stably and securely store the sportboard. This apparatus should be adaptable to different types of sportboards and it should be simple to manufacture, install and use.

SUMMARY OF THE INVENTION

It is thus the aim of this invention to provide an apparatus for storing sportboards that stably and securely restrains the sportboard, is easily adapted to sportboards of different sizes and shapes, is inexpensive and easy to manufacture, and is simple to install and use. The apparatus may also be used for holding a sportboard during servicing or routine maintenance.

Therefore there is provided an apparatus for storing sportboards, which apparatus comprises a first part and a second part secured together such that the first and second part slide relative to one another along a fixed axis. The first part and the second part each have a sleeve that will grip a portion of the sportboard. The sleeves are positioned such that in the assembled apparatus, the openings of the sleeves, in which the portions of the sportboard will be inserted, face one another. Either the first part or the second part is mountable to a wall or other support structure.

In use, either the first part or the second part is secured to a wall or other support structure and the other part is positioned substantially above it. To put a sportboard, such as a skateboard, into an apparatus in which the first part is secured and the second part is positioned above it, a first portion of the skateboard, such as the wheels at one end thereof or one of its ends, is placed into the sleeve of the second part. Then upwards force is exerted on the skateboard which force translates to the second part and causes it to slide upwardly, such that the distance between the sleeves is increased. The upwards force on the skateboard is continued until the second part has moved sufficiently far to allow a second portion of the skateboard to be aligned for insertion into the sleeve of the first part. The upwards force is then released and the second part moves downwards because of the force of gravity, which causes the second portion of the skateboard to be inserted in the sleeve on the first part.

In another embodiment of the invention, the first part and the second part are operatively connected by a resilient member that biases the parts toward one another, such that the operation is not dependent solely on gravity. In use, the part of this embodiment that is secured to a wall or other support structure can be fastened in any position, even a position which places the part that is not secured substantially underneath the secured part. To put a sportboard, such as a skateboard, into an apparatus in which the first part is secured and the second part is not, a first portion of the skateboard, such as the wheels at one end thereof or one of its ends, is placed into the sleeve of the second part. Then force is exerted on the skateboard which force translates to the second part and causes it to slide, such that the distance between the sleeves is increased. The force on the skateboard is continued until the second part has moved sufficiently far to allow a second portion of the skateboard to be aligned for insertion into the sleeve of the first part. The force is then released and the tension created in the resilient member causes the second part to move towards the first part, which causes the second portion of the skateboard to be inserted in the sleeve on the first part. The tension in the resilient member securely holds the skateboard in the sleeves of the apparatus.

DETAILED DESCRIPTION OF PREFERRED EMBODIMENTS

Figure 1:
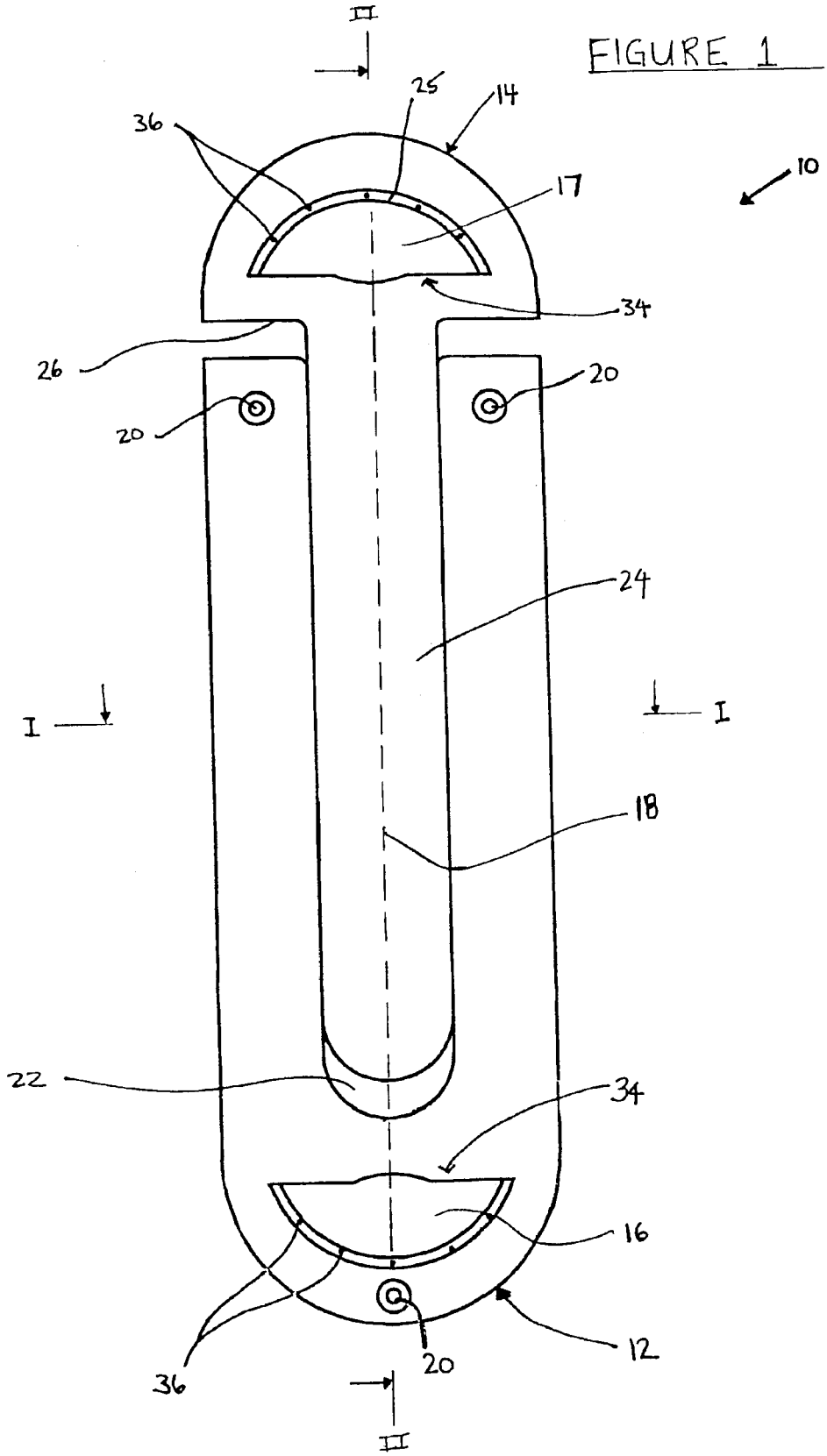
FIG. 1 is a front elevation view of an embodiment of the sportboard storage apparatus of this invention.

FIG. 1 shows a preferred embodiment of the sportboard storage apparatus 10 of this invention, including a first part 12 and a second part 14 each with a sleeve 16, 17. First part 12 and second part 14 slide relative to one another along a fixed axis 18.

Either the first part or the second part is securable to a wall or other support surface. Attachment can be achieved by a number of means, such as for example by using bolts, screws or nails, which pass through holes in the part that is to be secured, or by the use of clamps or glue. As shown in FIG. 1, first part 12 is secured by three fasteners 20, which pass through holes in the first part and into a support structure such as a wall. The position of fasteners 20 on first part 12 can be varied and more or fewer fasteners can be used, provided that in any event first part 12 is securely attached to a wall or other support surface.

The first part and second part are secured to one another and operatively connected such that one part slides along fixed axis 18 relative to the other part. This can be accomplished for example by the embodiment shown in FIG. 1. In this embodiment, first part 12 has formed therein a channel 22 that is substantially in the center of the first part, and second part 14 forms an extension 24 said extension extending essentially from the center of the second part.

Channel 22 can be any structure that guides the movement of the second part relative to the first part along axis 18. As shown in FIG. 1, channel 22 is a "U" shaped opening and is open at one end and closed at the other. Channel 22 could alternatively be rectangular, or open at both ends. Alternatively, channel 22 could be formed as a hole, or as a groove along the face of the part. Channel 22 need not be positioned centrally on the first part, as shown, but rather could be positioned to one side of center, or even along one edge of apparatus 10. Alternatively, there may be more than one channel, for example two channels on either side of a center axis or on both outside edges of apparatus 10.

Extension 24 can be any shape that will fit within and cooperate with channel 22. In the embodiment shown in FIG. 1, second part 14 has an end portion 26 from which extension 24 extends. Extension 24 is formed to extend to the end of channel 22 where it abuts first part 12, however it need not extend all the way to the bottom of channel 22 in order to function properly in the apparatus. Extension 24 can be other shapes as well, for instance if channel 22 is a hole, then extension 24 would be in the shape of a rod and if channel 22 is a groove along the face of the other part, then extension 24 would be a tongue to fit within that groove. The size, numbers and position of extension 24 need only be selected to cooperate with channel 22 to slide there along.

Figure 2:
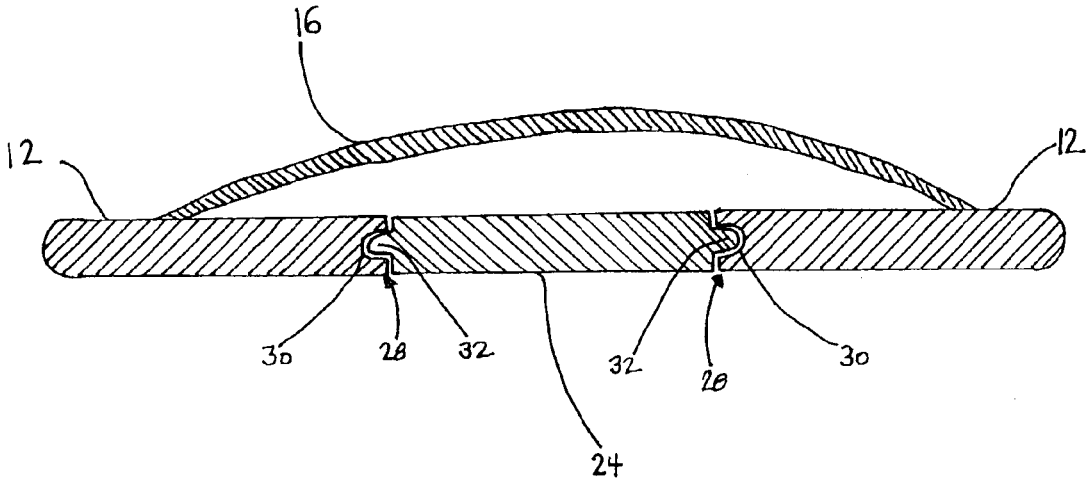
FIG. 2 is a cross sectional view of the sportboard storage apparatus taken along line I—I of FIG. 1.

In apparatus 10, first part 12 and second part 14 are secured to one another, yet movable along axis 18. Channel 22 and extension 24 can function both to secure the first part and second part together and to direct movement along axis 18. For example, FIG. 2 shows a cross-sectional view of the apparatus of FIG. 1, with the section being taken along line I—I of FIG. 1, and demonstrates how the edge of extension 24 associates with and slides within channel edge 28 of first part 12. In this embodiment, channel edge 28 of first part 12 has grooves 30 that run along the entire straight portion of the channel edge. The side edges of extension 24 have formed thereon tongues 32 that fit in and slide along grooves 30. Tongues 32 are continuous along the entire straight portion of the side edges of extension 24, but the same function can be obtained if tongues 32 extend along only a selected portion of the edge of extension 24, or by a series of smaller notches that are spaced along the length of extension 24 and that fit within grooves 30. In an alternative embodiment, the grooves are on the side edges of extension 24, and the tongues are on the channel edge 28 of first part 12.

In alternative embodiments, a tongue and groove mechanism between the channel and the extension is not needed in order to ensure that the first part and second part are secured together. For instance in the embodiment wherein channel 22 is formed from a hole in first part 12, and extension 24 is therefore in the shape of a rod, first part and second part are secured together because extension 24 fits and is secured within channel 22.

In yet another embodiment, the channel and extension function to guide the direction and scope of movement of the first part relative to the second part, and another device is used to secure the parts together. For instance, an apparatus 10 could be constructed with a first part and a second part that are planar and overlap, excepting where the sleeves are positioned. In this embodiment, channel 22 may be a groove along the face of one part and extension 24 may be a tongue that extends from the face of the other part, and which fits within that groove. The first part and second part may be held together by other means, such as brackets that are placed at the edges of the apparatus.

First part 12 and second part 14 are preferably constructed of a sturdy and lightweight planar material, including Plexiglas, fiberglass, plastic, wood, metal, Intecel™ or PCB. The dimensions of the apparatus can vary depending upon the shape and size of the sportboard that will be stored in the apparatus.

Each of the first part and the second part has a sleeve 16, 17 which functions to grip a portion of the sportboard such that the sportboard is securely held in apparatus 10. The sleeves are preferably positioned opposite one another at either end of apparatus 10, with openings 34 facing each other. The openings of the sleeves are of sufficient size that the portion of the sportboard to be stored can be inserted therein by the operator of the apparatus. Sleeves 16, 17 may have different dimensions, because some sportboards, such as surfboards, have ends with different shapes, which would best be accommodated by differently shaped sleeves. The sleeves are attached to first part 12 and second part 14 in a manner that will avoid slippage of the sportboard therethrough. This attachment can be accomplished, for instance, by securing the sides of sleeves 16, 17 that are opposite to opening 34, to first part 12 or second part 14 by any one of a number of means, such as nails, rivets, screws, or by forming them integral therewith. As shown in FIG. 1, a series of sleeve fasteners 36 are used. Slippage of the sportboard through the sleeves 16,17 could also be avoided by restricting the width of the sleeves at the side opposite opening 34, such that although the sides opposite opening 34 are open, the opening is too narrow for the ends of the sportboard to slip through. In this embodiment, shown in FIG. 4, the sleeve fasteners are positioned along the sides of the sleeve.

Figure 4:
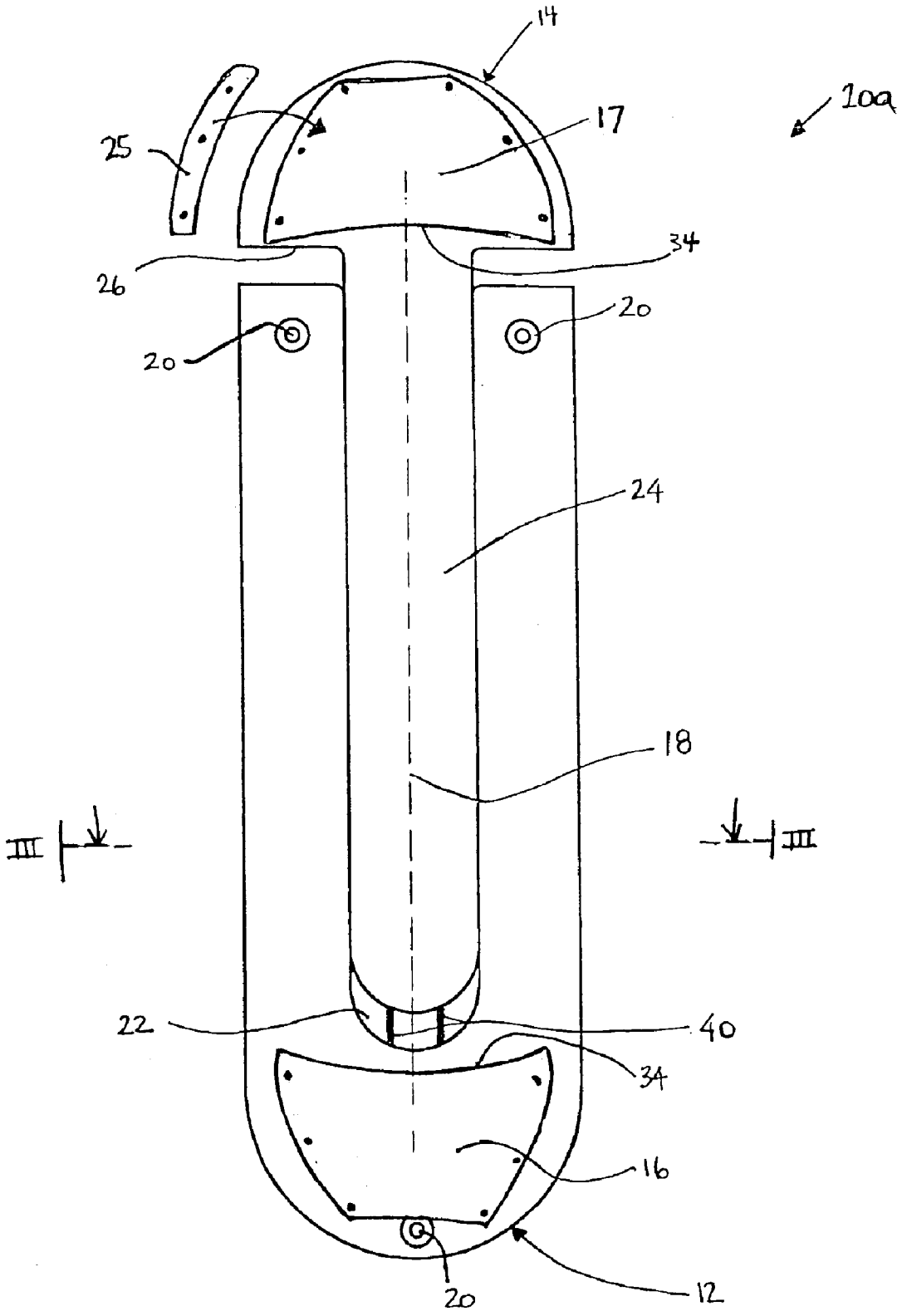
FIG. 4 is a front elevation view of an embodiment of the sportboard storage apparatus of this invention comprising a resilient member.

Sleeves 16, 17 are preferably constructed of a flexible material such as rubber, plastic or cloth and openings 34 are created where the flexible material is not attached to first part 12 or second part 14. In some instances it may be desirable to use a support 25 as shown in FIGS. 1 and 4, that is positioned between the material from which the sleeve is made and the end of the sleeve fasteners 36. Support 25 acts as a reinforcing agent, and prevents the holes on sleeves 16, 17 through which sleeve fasteners 36 pass, from ripping or tearing. Alternatively sleeves 16, 17 could be made of a rigid material such as metal or plastic, if a more defined structure of the sleeve is needed to selectively engage a portion of a sportboard. For instance, if the wheels of a skateboard, or the keel of a surfboard is to be held in the sleeves, it may be preferable that the sleeve be comprised of a rigid material rather than a flexible material.

Figure 3:
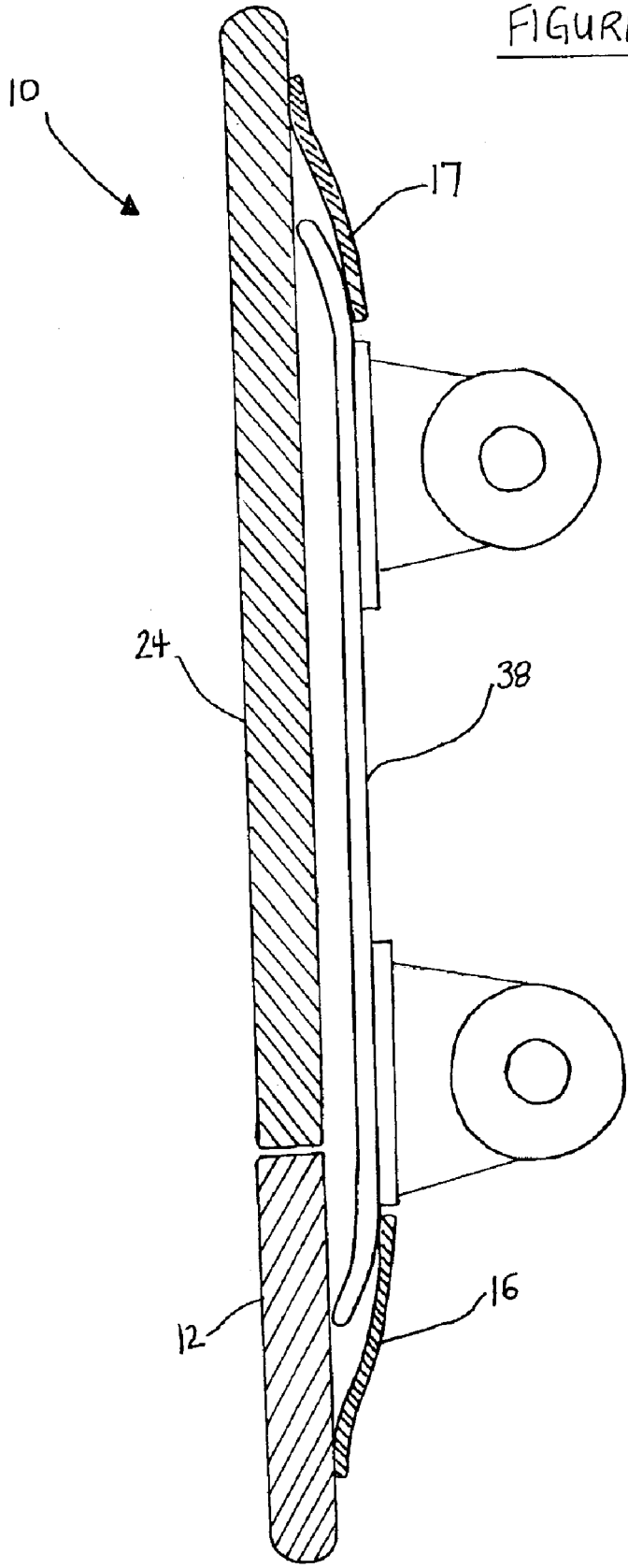
FIG. 3 is a cross sectional view of the sportboard storage apparatus taken along line II—II of FIG. 1, with an elevation view of a skateboard stored therein.

FIG. 3 shows a cross sectional view of apparatus 10 holding a skateboard 38, which is shown in elevation view. To put a sportboard, such as a skateboard into a vertically wall-mounted apparatus 10 as illustrated in FIGS. 1–3, the first end of a skateboard is placed into sleeve 17 of second part 14, with the wheels pointing away from the apparatus. Then upwards force is exerted on the skateboard, which force translates to second part 14 and causes second part 14 to slide upwards. The upwards force on the skateboard is continued until second part 14 has moved sufficiently far to allow the second end of the skateboard to be positioned above the opening in sleeve 16 on first part 12. The upwards force is then released and the force of gravity causes the second part to move downwards, which results in the insertion of the second end of the skateboard into sleeve 16 of the first part. In order to remove the skateboard from the apparatus, upwards force is exerted on the skateboard, which force causes second part 14 to slide upwards. The upward force on the skateboard is continued until second part 14 has moved sufficiently far to allow the second end of the skateboard to be removed from sleeve 16 of first part 12. The upward force is then released and the first end of the skateboard is removed from sleeve 17 of second part 14 and the force of gravity causes second part 14 to move downwards along channel 22.

In an alternative embodiment 10*a* of this invention, shown in FIG. 4, a resilient member 40 connects first part 12 and second part 14. Resilient member 40 connects first part 12 and second part 14 as shown in FIG. 5A, which shows the back side of the embodiment shown in FIG. 4. As shown in FIG. 5A, resilient member 40 sits in an oblong depression 42 which extends along the back of both first part 12 and second part 14. This depression allows apparatus 10 to be mounted flush against the support surface. Resilient member 40 must be fastened, either permanently or reversibly to apparatus 10, to ensure that it does not fall out of depression 42 during or between uses. As shown in FIG. 5B, which is a partial cross section of FIG. 5A taken along line IV—IV, and shows the bottom part of depression 42, resilient member 40 is reversibly fastened by the fact that at each end of depression 42, there is a lip 44 underneath which the resilient member fits.

Figure 5:
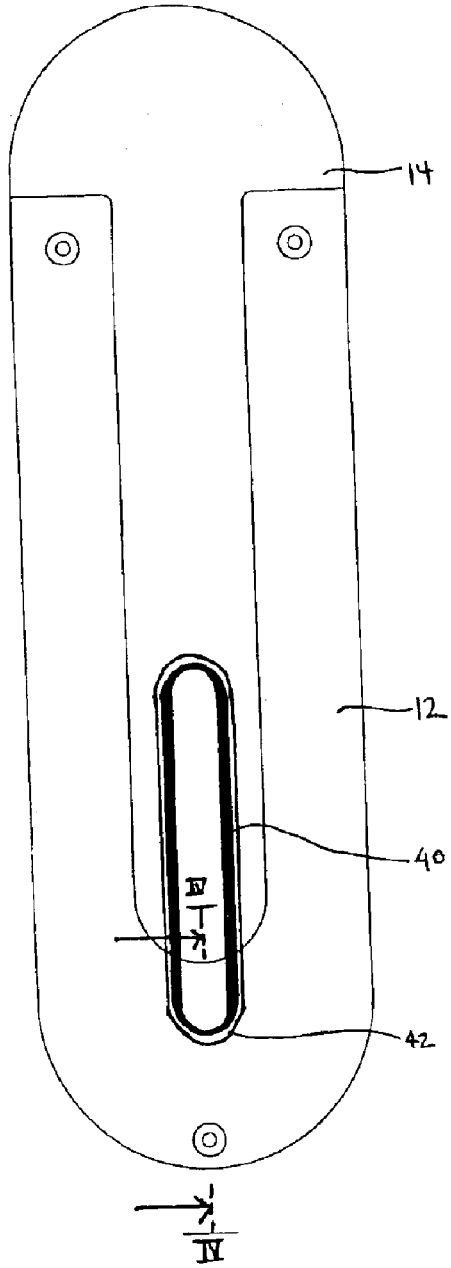
FIG. 5A is a back elevation view of the embodiment of the sportboard storage apparatus shown in FIG. 4.
FIG. 5B is a partial cross-section taken along line IV—IV in FIG. 5A, and showing the end of depression 42 in first part 12.
Figure 5:
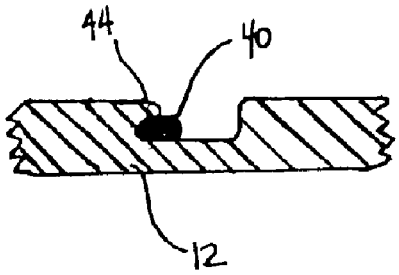

In the embodiment shown in FIG. 5, resilient member 40 is an elastic band that is reversibly fastened to apparatus 10. Resilient member 40 could also be a spring, or any other material or device that can be stretched or expanded to allow insertion of the sportboard into the apparatus, using the method described herein below. Therefore, resilient member 40 must allow the first part and second part to slide apart sufficiently such that the sportboard to be stored can be inserted into the sleeves of the apparatus. Instead of being reversibly attached, resilient member 40 may also be permanently attached to first part 12 and second part 14, for example by screws or nails. Resilient member 40 functions to ensure that parts 12 and parts 14 do not become separated during use, but in a preferred embodiment also functions to bias the sleeves towards one another with sufficient force to bring the two sleeves together thus securing the sportboard firmly between them.

Figure 6:
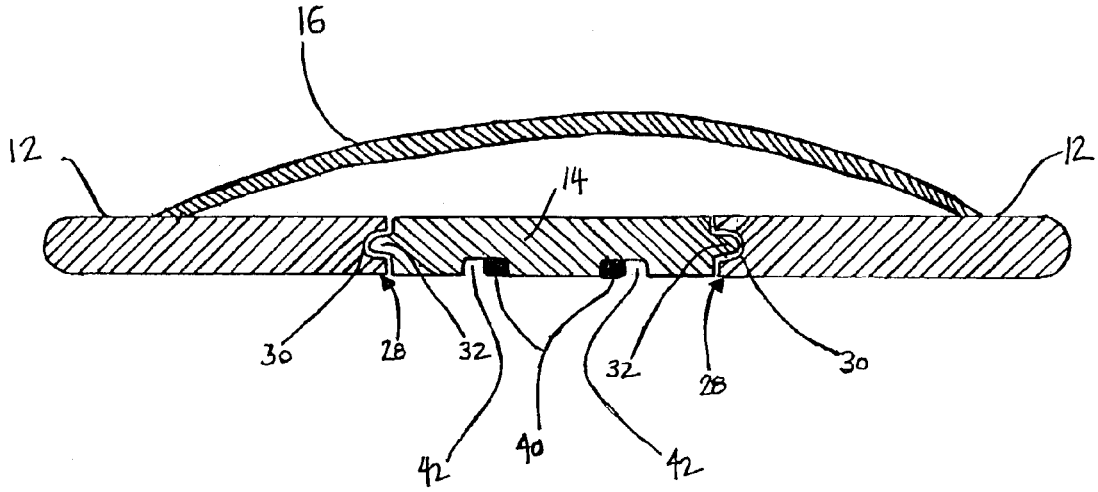
FIG. 6 is a cross sectional view of the sportboard storage apparatus of this invention. The section is taken along line III—III of FIG. 4.

FIG. 6 is a cross section of apparatus 10*a* taken along line III—III of FIG. 4. This cross section demonstrates how resilient member 40 is situated in depression 42 within second part 14. In yet another embodiment of this invention, lip 44 extends along the entire edge of depression 42, to hold resilient member 40 in place. While it is preferred that resilient member 40 be situated in depression 42 of apparatus 10, so that the apparatus can be held flush against a support surface, alternative embodiments with a resilient member 40 that is positioned on, rather than within, the rear planar surface of the apparatus are intended to be included in this invention.

When there is no sportboard in the apparatus, sleeves 16, 17 will be spaced apart a predetermined distance. The force of gravity in the embodiment shown in FIG. 1, resilient member 40 as shown in FIG. 4, or both, will pull the sleeves towards one another until some form of resistance which stops the movement is encountered. The apparatus of this invention will therefore comprise an element that functions to stop the movement of the sleeves towards one another when the apparatus is empty. As shown in FIG. 1 or 4, movement of the sleeves towards one another would be stopped either when the end of extension 24 abuts the end of channel 22, or when the edge of end portion 26 abuts the edge of first part 12. It is apparent that extension 24 need not extend all the way to the end of channel 22, or alternatively, that the flat edge of end portion 26 need not abut the edge of first part 12, as either of these two arrangements will independently achieve the same result of halting the movement of second part 14 towards first part 12. Other means of stopping the movement of the sleeves towards one another include placement of channels or extensions to restrict the movement of the first part and the second part relative to one another, or the use of a device such as a peg, to obstruct the movement of the first part and the second part relative to one another.

Apparatus 10*a* shown in FIGS. 4–6 would hold a skateboard 38, in the same manner as shown in FIG. 3. Sleeves 16, 17 would hold skateboard 38 in position, however resilient member 40 would provide additional tension force to hold the skateboard in position, because it biases the sleeves towards one another. To put a sportboard, such as a skateboard into a vertically wall-mounted apparatus 10*a* as illustrated in FIGS. 4–6, the first end of the skateboard is placed into sleeve 17 of second part 14, with the wheels pointing away from the apparatus. Then upwards force is exerted on the skateboard, which force translates to second part 14 and causes second part 14 to slide upwards. The upward force required is greater than in the embodiment shown without the resilient member. This upwards force on the skateboard is continued until second part 14 has moved sufficiently far to allow the second end of the skateboard to be positioned above the opening in sleeve 16 on first part 12. The upwards force is then released and the tension created by resilient member 40, as well as the force of gravity, cause the second part to move downwards, which results in the insertion of the second end of the skateboard into sleeve 16. The tension in the resilient member assists in securely holding the skateboard in the sleeves of the apparatus. In order to remove the skateboard from the apparatus, upwards force is exerted on the skateboard, which force causes second part 14 to slide upwards. The upward force on the skateboard is continued until second part 14 has moved sufficiently far to allow the second end of the skateboard to be removed from sleeve 16 of first part 12. The upward force is then released and the first end of the skateboard is removed from sleeve 17 of second part 14 as the tension in resilient member 40 and the force of gravity cause second part 14 to move downwards along channel 22.

As is apparent, apparatus 10*a* of the invention shown in FIGS. 4–6 need not be substantially vertically mounted, with the moveable part above the attached part, in order to operate to hold a sportboard. It can be mounted horizontally, or upside-down to that shown in FIG. 1, or at any angle in-between. If the apparatus is to be used by small children for instance, it may be easier for them to apply downwards force to second part 14, rather than upwards force, in order to mount a sportboard into the apparatus, and therefore the apparatus would be mounted upside-down to that shown in FIG. 4. In this arrangement, the resilient member would be selected such that it could withstand the weight of the sportboard itself.

As is also apparent, apparatus 10 of this invention shown in FIGS. 1–3 would also operate to hold a sportboard if it were mounted substantially horizontally, or at any angle between vertical and horizontal, as long as the part of the apparatus which slides is not below the part that is affixed to the support surface in such a manner that the part which slides would fall out of the apparatus. However, the further that the apparatus is removed from a vertical position as shown in FIG. 1, the lesser will be the force of gravity on the movement downwards of the part which slides and the greater will be the need of the operator of the apparatus to physically push sleeves 16, 17 together.

FIGS. 1 and 4 show the shape of the preferred embodiment of this apparatus, with first part 12 formed in the shape of a planar "U" and defining channel 22, and second part 14 being in mushroom shaped and forming extension 24 that fits within the channel. It is apparent that apparatus 10 or 10*a* could be constructed in any one of a number of shapes and still function on the same principles. For instance, the rounded edges in the apparatus could be square, such that second part 14 is T-shaped, and the end of channel 22 has right angles, rather than curves. Second part 14 and first part 12 need not each be comprised of one piece, but could be formed from several pieces that are attached, for example by bolts, screws, nails or glue. Alternative shapes of apparatus 10, which function on the principle that there is a first part and a second part each containing a sleeve, said parts being secured together and operatively connected such that they move along a fixed axis relative to one another, are intended to be included in this invention.

FIGS. 1 and 4 show an embodiment of this apparatus, in which the first part forms channel 22 and is fixed to a support surface, and the second part is moveable and has extension 24 that fits in the channel. In an alternative embodiment of this invention, the part with the extension is secured to the support surface, and the part that forms the channel is moveable.

While the invention has been described with reference to specific embodiments thereof, it will be appreciated that numerous variations, modifications and embodiments are possible and all such variations and embodiments are to be regarded as being within the spirit and scope of the invention.

What is claimed is:

1. A sportboard storage apparatus for holding an elongate sportboard having a first end, a second end, and two side edges, comprising:

(a) a first part having a first sleeve to grip the first end of the sportboard, and (b) a second part having a second sleeve to grip the second end of the sportboard, the first part and the second part being slidably connected such that the first part slides relative to the second part, along a fixed axis to move the sleeves toward and away from each other, and wherein the first sleeve and the second sleeve retain the sportboard in the apparatus in a fixed position relative to the apparatus.

2. A sportboard storage apparatus of claim 1 further comprising a resilient member connecting the first part to the second part, the resilient member biasing the first part toward the second part.

3. A sportboard storage apparatus of claim 2 wherein the first part is mountable on a support surface.

4. A sportboard storage apparatus of claim 2 wherein the second part is mountable on a support surface.

5. A sportboard storage apparatus of claim 2 wherein one part defines a channel and the other part forms an extension that is operatively connected to the channel to slide therealong.

6. A sportboard storage apparatus of claim 5 wherein an edge of the extension is formed to fit within and slide along a groove formed by an edge of the channel.

7. A sportboard storage apparatus of claim 5 wherein an edge of the channel is formed to fit within and slide along a groove formed by an edge of the extension.

8. A sportboard storage apparatus of claim 2 wherein the resilient member is comprised of an elastic material.

9. A sportboard storage apparatus of claim 2 wherein the resilient member is comprised of a spring.

10. A sportboard storage apparatus of claim 2 wherein the resilient member is situated in a depression formed by the first part and the second part.

11. A sportboard storage apparatus of claim 5, wherein at least one of the first sleeve and the second sleeve is U-shaped.

12. A sportboard storage apparatus of claim 2, wherein at least one of the first sleeve and the second sleeve is U-shaped.

13. A sportboard storage apparatus of claim 1 wherein the first part is mountable on a support surface.

14. A sportboard storage apparatus of claim 1 wherein the second part is mountable on a support surface.

15. A sportboard storage apparatus of claim 1 wherein one part defines a channel and the other part forms an extension that is operatively connected to the channel to slide therealong.

16. A sportboard storage apparatus of claim 15 wherein an edge of the extension is formed to fit within and slide along a groove formed by an edge of the channel.

17. A sportboard storage apparatus of claim 15 wherein an edge of the channel is formed to fit within and slide along a groove formed by an edge of the extension.

18. A sportboard storage apparatus of claim 15, wherein at least one of the first sleeve and the second sleeve is U-shaped.

19. A sportboard storage apparatus of claim 1, wherein at least one of the first sleeve and the second sleeve is U-shaped.

20. A method of mounting an elongate sportboard with a first end, a second end and two side edges in a storage apparatus, comprising:

(a) providing a sportboard storage apparatus that comprises:

(i) a first part having a first sleeve to grip the first end of the sportboard, and (ii) a second part having a second sleeve to grip the second end of the sportboard, the first part and the second part being slidably connected such that the first part slides relative to the second part, along a fixed axis to move the sleeves toward and away from each other, and (b) inserting the first end of the sportboard into the first sleeve and inserting the second end of the sportboard into the second sleeve when the first sleeve and the second sleeve are separated a distance that is greater than the distance between the first end and the second end of the sportboard, (c) moving the first sleeve and the second sleeve towards one another until they grip the first end and the second end of the sportboard and retain the sportboard in a fixed position relative to the apparatus, respectively.

21. The method of claim 20 wherein a resilient member connects the first part to the second part thereby biasing the first part toward the second part.

22. The method of claim 20 wherein one of the first part and the second part is mounted to a support surface.

* * * * *